US006951469B1

(12) United States Patent
Lin

(10) Patent No.: US 6,951,469 B1
(45) Date of Patent: Oct. 4, 2005

(54) ELECTRIC OUTLET DUST PROTECTIVE STRUCTURE

(75) Inventor: Kuan-Lin Lin, Taipei (TW)

(73) Assignee: Hsing Chau Industrial Co., Ltd., Taipei (TW)

( * ) Notice: Subject to any disclaimer, the term of this patent is extended or adjusted under 35 U.S.C. 154(b) by 15 days.

(21) Appl. No.: 10/884,942

(22) Filed: Jul. 7, 2004

(51) Int. Cl.[7] ..... H01R 3/03
(52) U.S. Cl. ..... 439/135; 439/136; 439/519
(58) Field of Search ..... 439/138, 136, 439/519, 521

(56) References Cited

U.S. PATENT DOCUMENTS 4,497,526 A * 2/1985 Myers ..... 439/79
4,556,264 A * 12/1985 Tanaka ..... 439/62
5,385,488 A * 1/1995 Clark ..... 439/557
6,196,880 B1 * 3/2001 Goodrich et al. ..... 439/676
6,482,039 B2 * 11/2002 Phommachanh et al. ... 439/620
6,641,443 B1 * 11/2003 Itano et al. ..... 439/676
6,716,054 B1 * 4/2004 Denovich et al. ..... 439/404
6,719,588 B1 * 4/2004 Zheng et al. ..... 439/620
6,729,899 B2 * 5/2004 Aekins et al. ..... 439/404
6,729,906 B1 * 5/2004 Simmons et al. ..... 439/607
6,736,673 B1 * 5/2004 Simmons et al. ..... 439/541.5

* cited by examiner

*Primary Examiner*—Gary Paumen
*Assistant Examiner*—Phuongchi Nguyen
(74) *Attorney, Agent, or Firm*—Troxell Law Office, PLLC

(57) ABSTRACT

An electric outlet dust protective structure used in an electric outlet to close the front opening of the housing of the electric outlet when the electric outlet is not inserted with an electric plug is disclosed to include a top dust cover, which has a top finger strip and an actuating block with two sloping side edges, left and right side dust covers each having a respective sloping top guide face maintained in contact with the sloping side edges of the actuating block and a respective guide groove coupled to a respective guide rod at the top dust cover for easy downward movement with the top dust cover to open the front opening of the housing, and two spring members that support the left and right side dust covers and the top dust cover in the close position to close the front opening of the housing.

7 Claims, 26 Drawing Sheets

ELECTRIC OUTLET DUST PROTECTIVE STRUCTURE

BACKGROUND AND SUMMARY OF THE INVENTION

The present invention relates to electric outlets and more specifically, to an electric outlet dust protective structure, which uses a top dust cover and two side dust covers to close the front opening of the housing of the electric outlet against outside dust and two compression springs to support the dust covers in the close position.

FIGS. 1~3 show an electric outlet dust protective structure according to the prior art. According to this design, the electric outlet dust protective structure is comprised of an electric outlet housing 911, a dust cover 912, a torsional spring 913, a back cover 914, and a terminal holder body 915. This design of electric outlet dust protective structure has drawbacks as follows:

1. When connecting an electric plug to the electric outlet, the user must open the terminal holder body 915 by lifting the dust cover 912 to compress the torsional spring 913, however lifting the dust cover 912 requires much effort.
2. The torsional spring 913 wears quickly with use. When started to wear, the torsional spring 913 may be unable to hold the dust cover 912 in the close position.

FIGS. 4~6 show another design of electric outlet dust protective structure according to the prior art. According to this design, the electric outlet dust protective structure is comprised of an electric outlet housing 921, a main dust cover 922, an auxiliary dust cover 923, a compression spring 94, a locating plate 925, a back cover 926, and a terminal holder body 927. When opening the electric outlet, press the main dust cover 922 downwards to lower the auxiliary dust cover 923. This design requires less effort to open the dust covers 922, 923. However, if the electric outlet is installed in a corner area behind a furniture or an object, it is still inconvenient to approach the main dust cover 922.

Therefore, it is desirable to provide an electric outlet dust protective structure that eliminates the aforesaid drawbacks.

The present invention has been accomplished under the circumstances in view. It is therefore the main object of the present invention to provide an electric outlet dust protective structure, which can conveniently be operated with less effort. To achieve this and other objects of the present invention, the electric outlet dust protective structure is installed in the housing of an electric outlet and adapted to close the front opening of the housing of the electric outlet against outside dust when the module jack of the electric outlet is not inserted with an electric plug. The electric outlet dust protective structure comprises a top dust cover, which has a top finger strip and an actuating block with two sloping side edges, left and right side dust covers each having a respective sloping top guide face maintained in contact with the sloping side edges of the actuating block and a respective guide groove coupled to a respective guide rod at the top dust cover for easy downward movement with the top dust cover to open the front opening of the housing, and two spring members that support the side dust covers and the top dust cover in the close position to close the front opening of the housing.

DETAILED DESCRIPTION OF THE INVENTION

Figure 1:
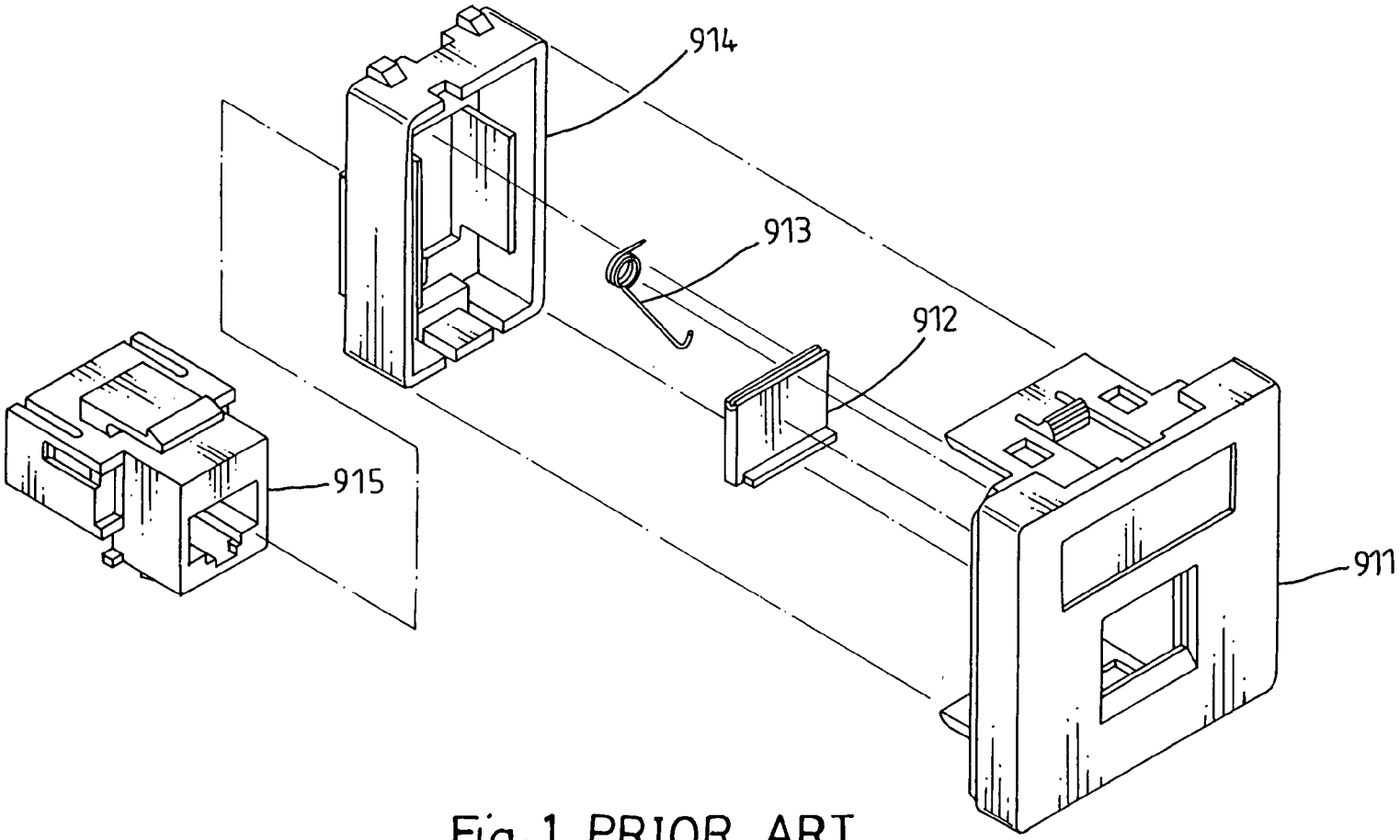
Fig. 1 PRIOR ART
FIG. 1 is an exploded view of an electric outlet dust protective structure according to the prior art.
Figure 2:
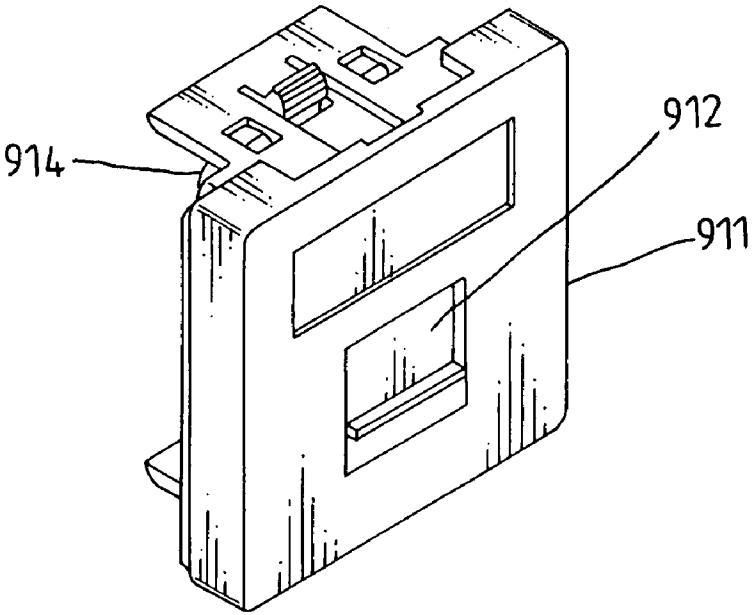
Fig. 2 PRIOR ART
FIG. 2 is an elevational assembly view of FIG. 1.
Figure 3:
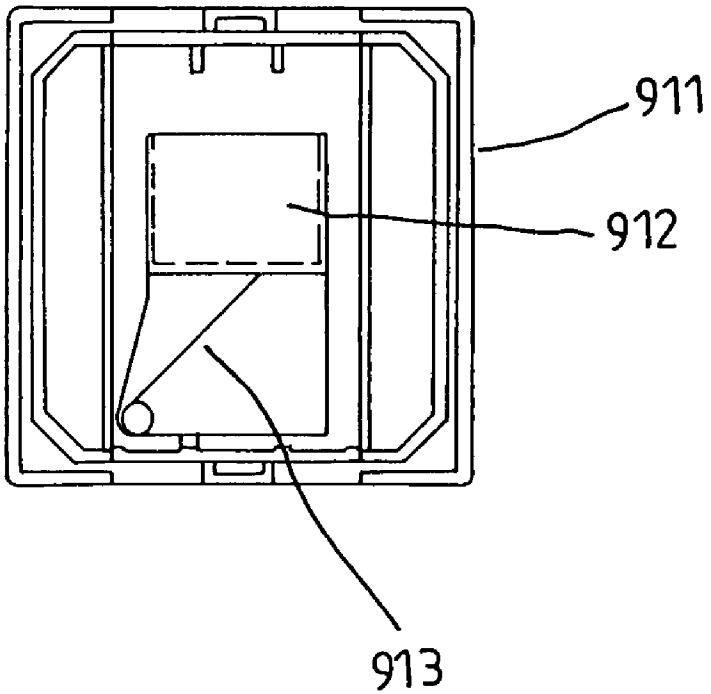
Fig. 3 PRIOR ART
FIG. 3 is a back side plain view of the electric outlet dust protective structure shown in FIG. 1.
Figure 4:
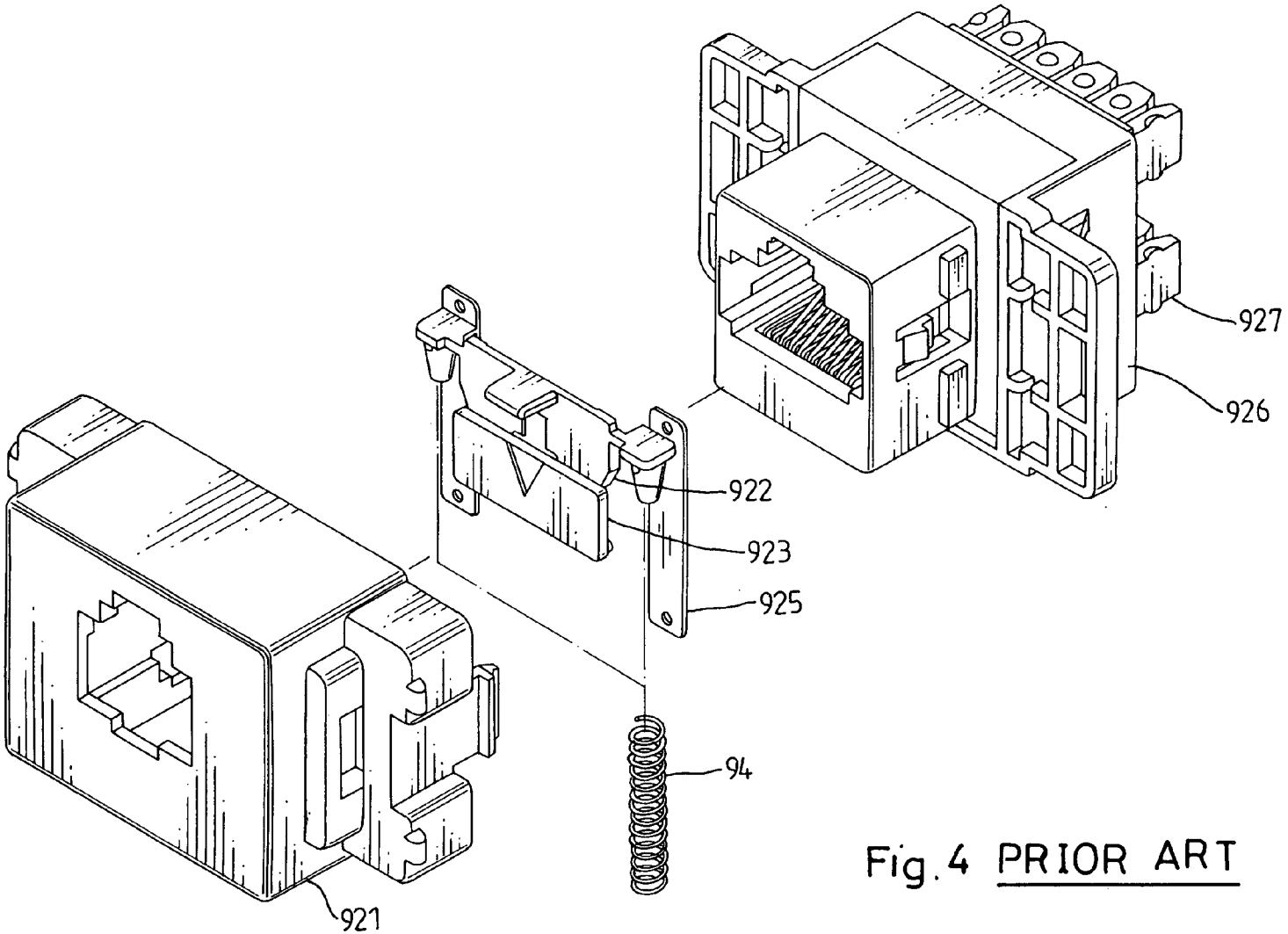
Fig. 4 PRIOR ART
FIG. 4 is an exploded view of another design of electric outlet dust protective structure according to the prior art.
Figure 5:
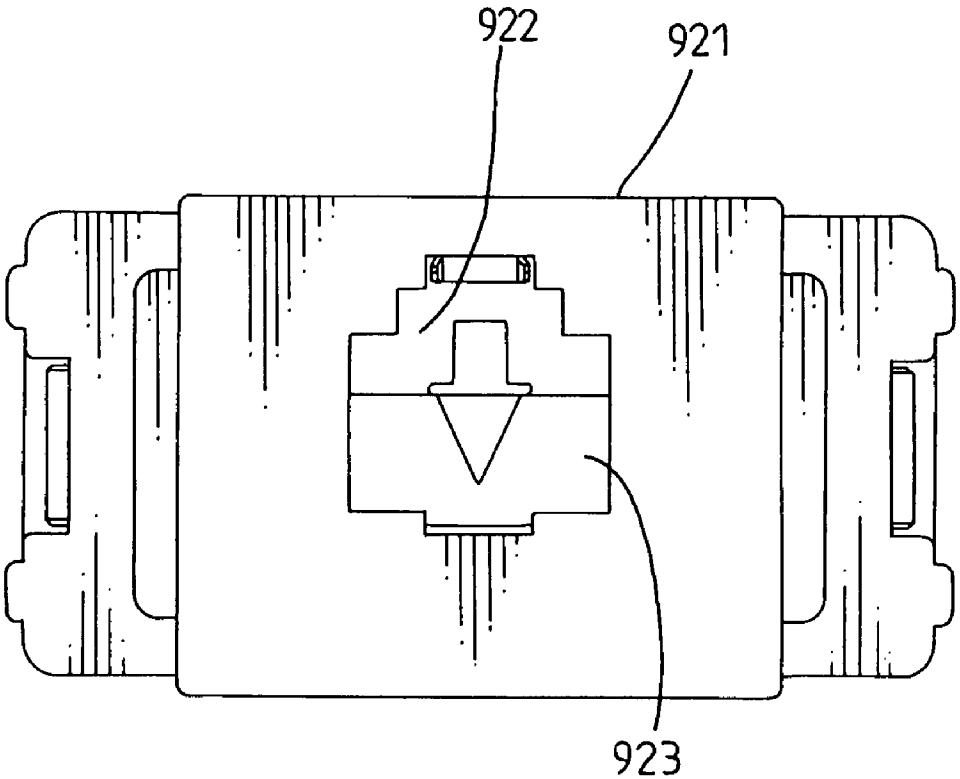
Fig. 5 PRIOR ART
FIG. 5 is a front view of the electric outlet dust protective structure shown in FIG. 4.
Figure 6:
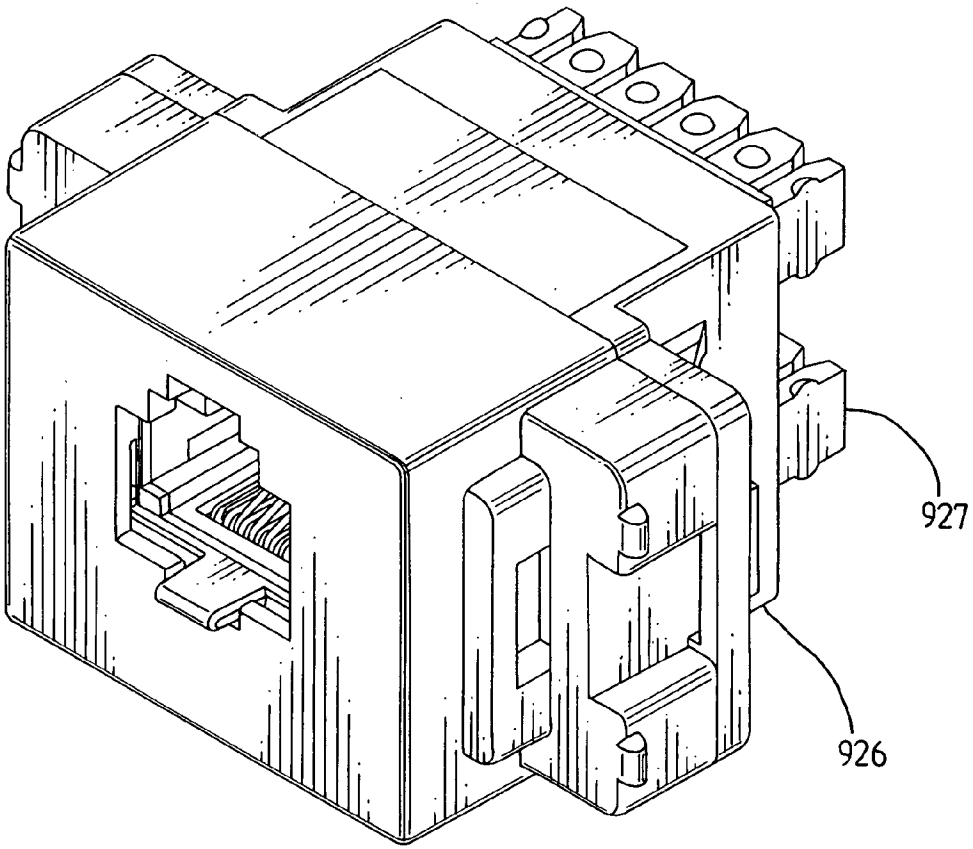
Fig. 6 PRIOR ART
FIG. 6 is an elevational assembly view of the electric outlet dust protective structure shown in FIG. 4.

Referring to FIGS. 7~17, an electric outlet dust protective structure in accordance with the first embodiment of the present invention is shown comprised of a top dust cover 1, left and right side dust covers 2, 3, left and right guide rails 4, 5, two compression springs 10, and an electric outlet formed of a housing 6 and a module jack (terminal holder body) 60. The housing 6 is comprised of a casing 62, a back cover 63, and a faceplate 64.

The top dust cover 1 comprises a flat base 11, a finger strip 111 extended from the top side of the flat base 11 at right angles and inserted through the front opening 61 of the casing 62 of the housing 6 from the inside toward the outside, an actuating block 112 protruded from the front side of the flat base 11, the actuating block 112 having two sloping side edges 1121, 1122 sloping downwardly inwards and then meeting each other at a point, two guide rods 113, 114 perpendicularly extended from the front side of the flat base 11 and respectively spaced from the sloping side edges 1121, 1122 of the actuating block 112 at a space, two side wings 115 symmetrically disposed at two opposite lateral sides of the flat base 11, and two locating rods 1151 respectively downwardly extended from the side wings 115.

Figure 7:
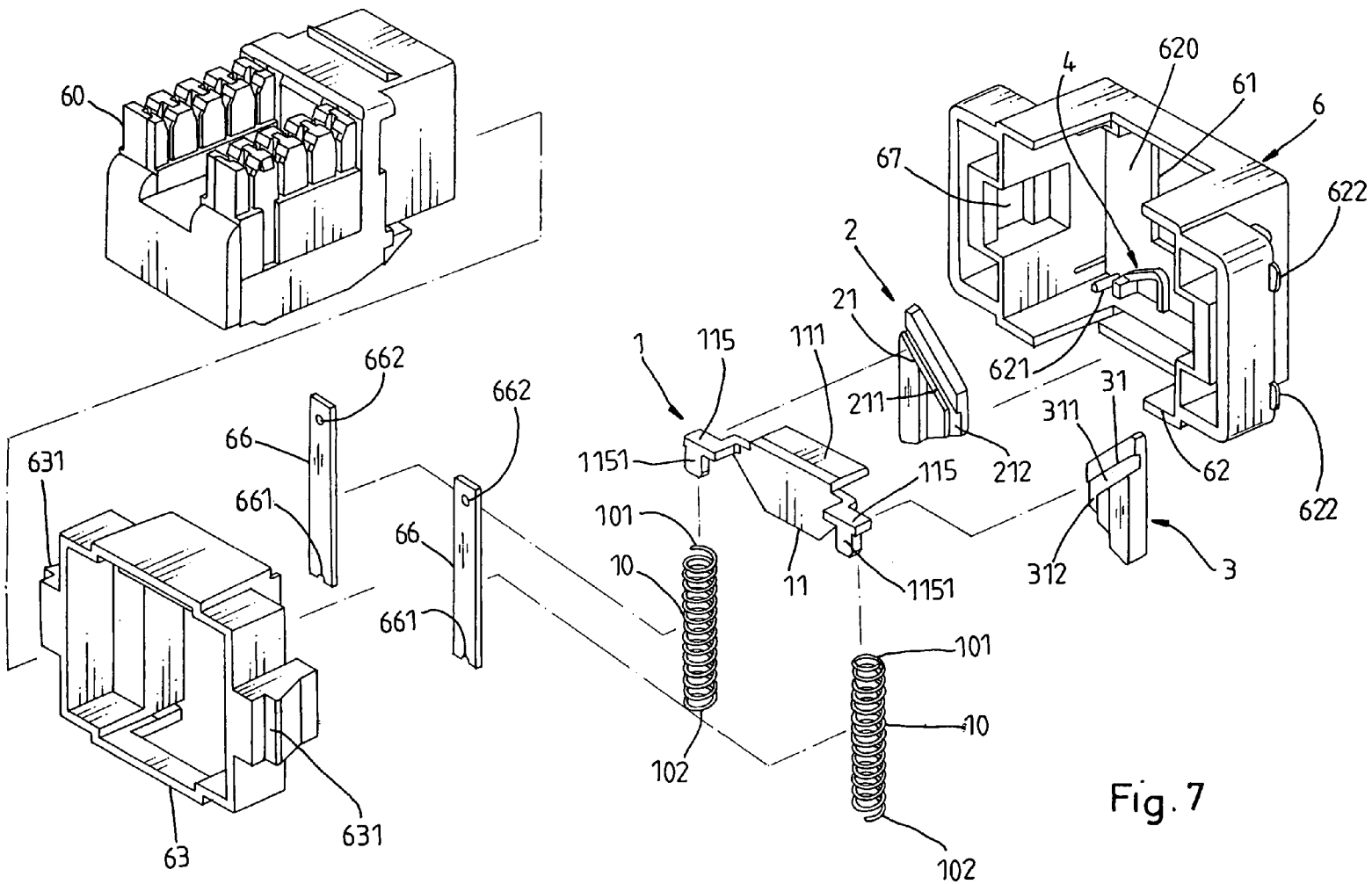
FIG. 7 is an exploded view of an electric outlet dust protective structure according to the first embodiment of the present invention.
Figure 9:
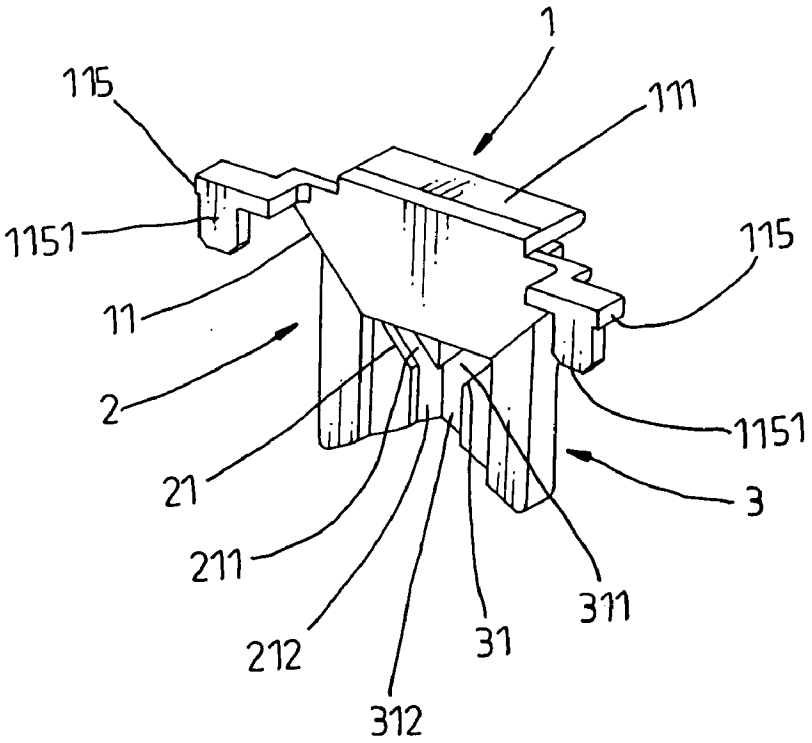
FIG. 9 is an oblique rear elevation of assembly of the top dust cover and the two side dust covers of the electric outlet dust protective structure according to the first embodiment of the present invention.
Figure 8:
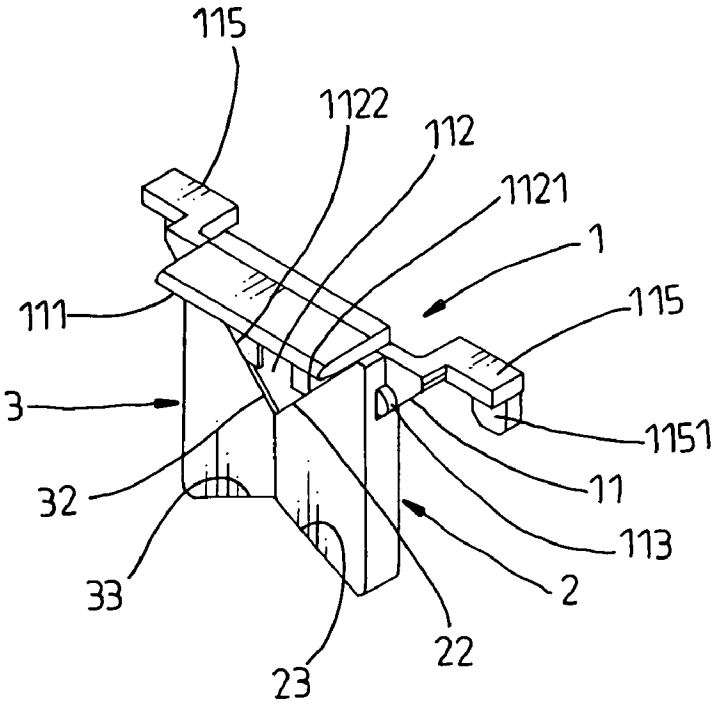
FIG. 8 is an oblique front elevation of the assembly of the top dust cover and the two side dust covers of the electric outlet dust protective structure according to the first embodiment of the present invention.

The left and right guide rails 4, 5 are provided at the top of the bottom wall of the casing 62 of the housing 6, each having a sloping guide face 41 or 51 sloping downwardly inwards (see FIG. 7).

The compression springs 10 are respectively supported between the top dust cover 1 and the bottom wall of the casing 62 of the housing 6, each having a top end 101 respectively fastened to the locating rods 1151 of the top dust cover 1 and a bottom end 102 respectively fastened to a respective locating block 621 at the bottom wall of the casing 62 of the housing 6.

The left and right side dust covers 2, 3 each have a sloping top guide face 22 or 32 fitting the sloping side edges 1121, 1122 of the actuating block 112 of the top dust cover 1, a sloping bottom guide edge 23 or 33 respectively kept in contact with the sloping guide faces 41, 51 of the left and right guide rails 4, 5 at the bottom wall of the casing 62 of the housing 6, and a back sliding groove 21 or 31 respectively coupled to the guide rods 113, 114 of the top dust cover 1. Each back sliding groove 21 or 31 has a sloping groove section 211 or 311, and a vertical groove section 212 or 312 vertically downwardly extended from the lowest end of the sloping groove section 211 or 311.

Figure 13:
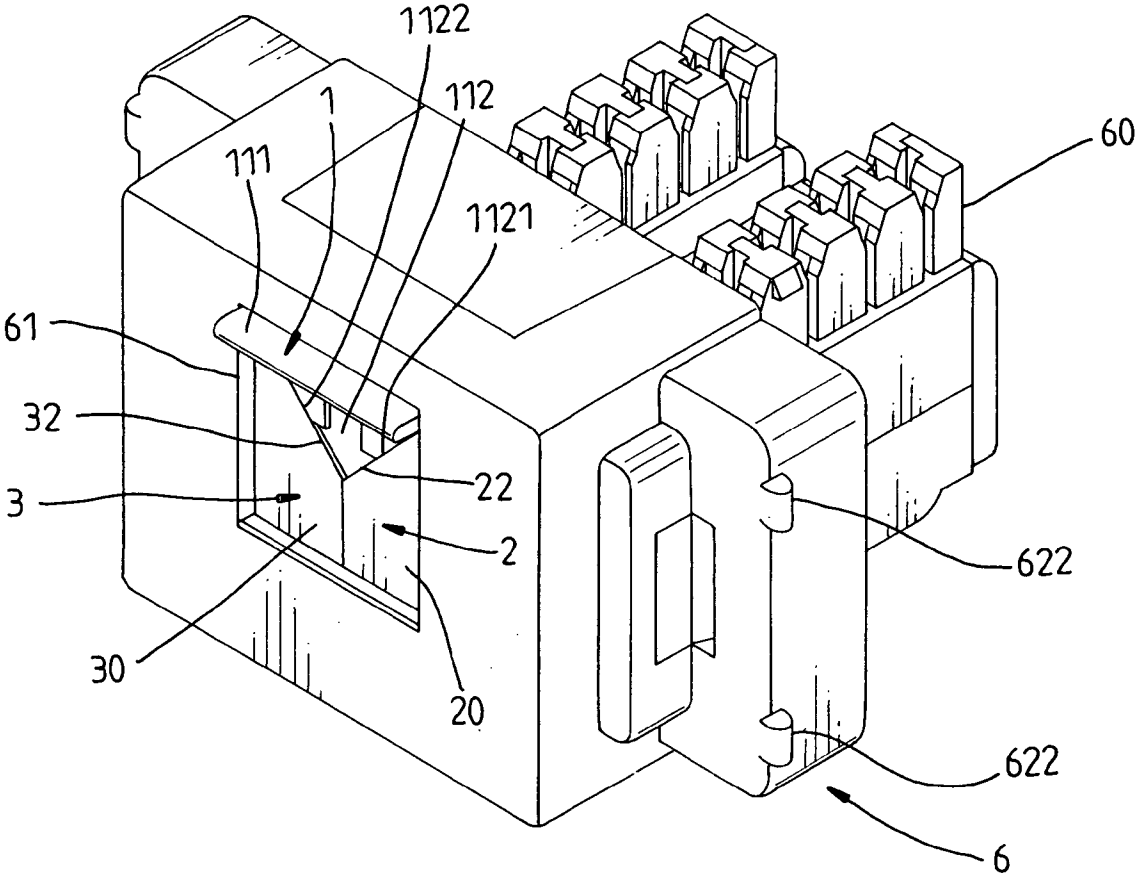
FIG. 13 is an oblique front elevation of the assembly of the electric outlet dust protective structure according to the first embodiment of the present invention.
Figure 14:
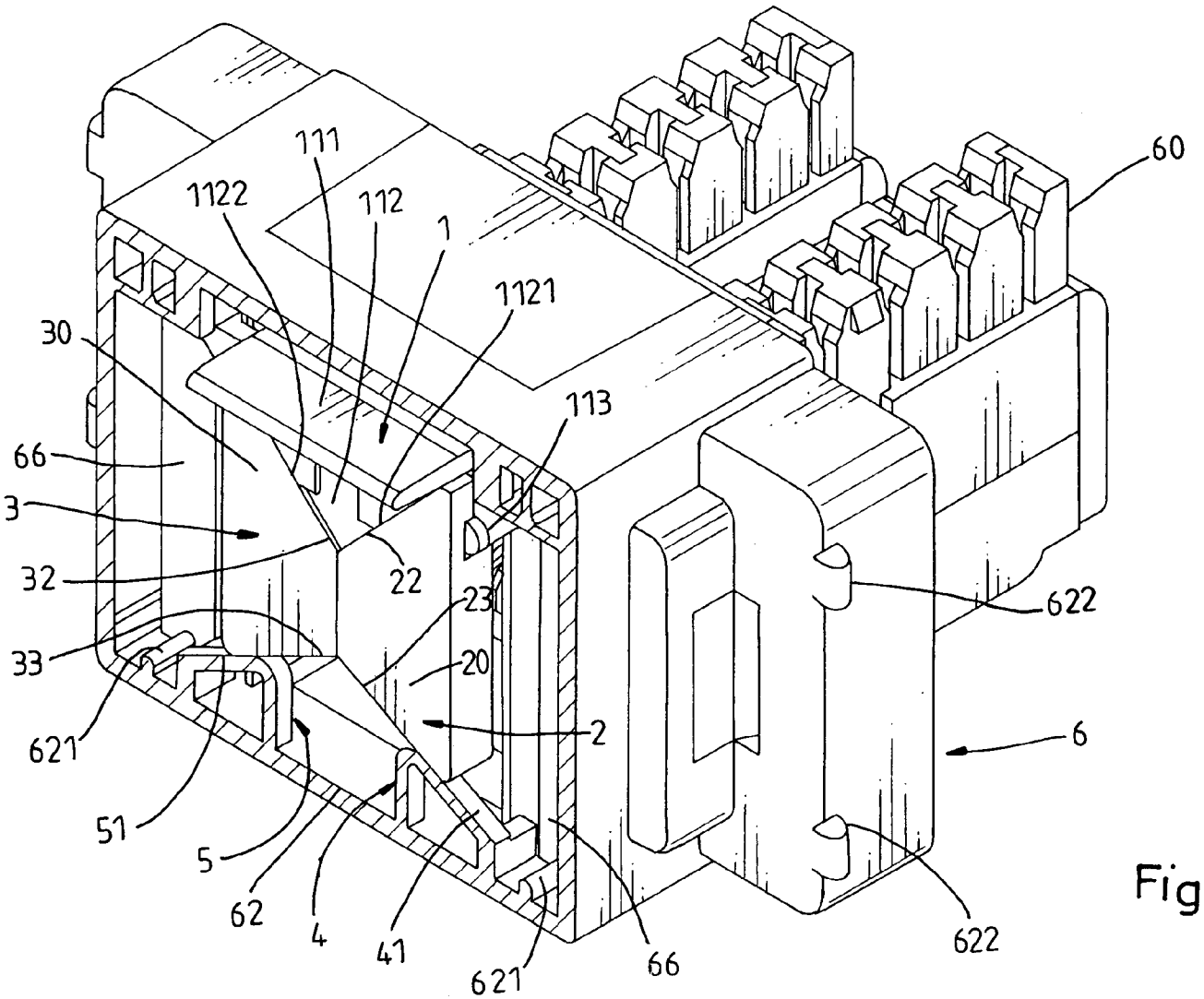
FIG. 14 is sectional elevation of the assembly of the electric outlet dust protective structure according to the first embodiment of the present invention.
Figure 15:
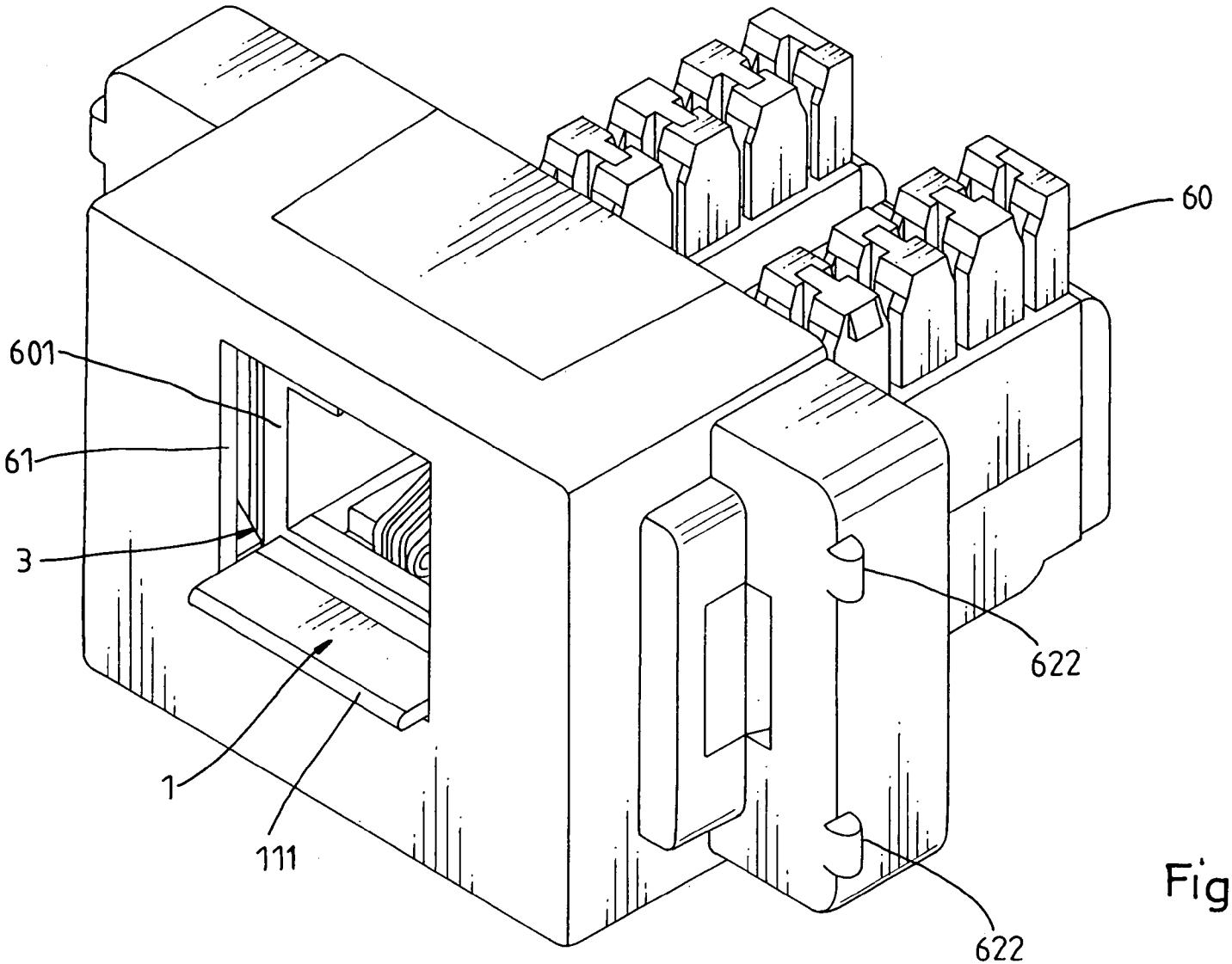
FIG. 15 is an elevational view of the first embodiment of the present invention, showing the open status of the electric outlet dust protective structure (I).
Figure 16:
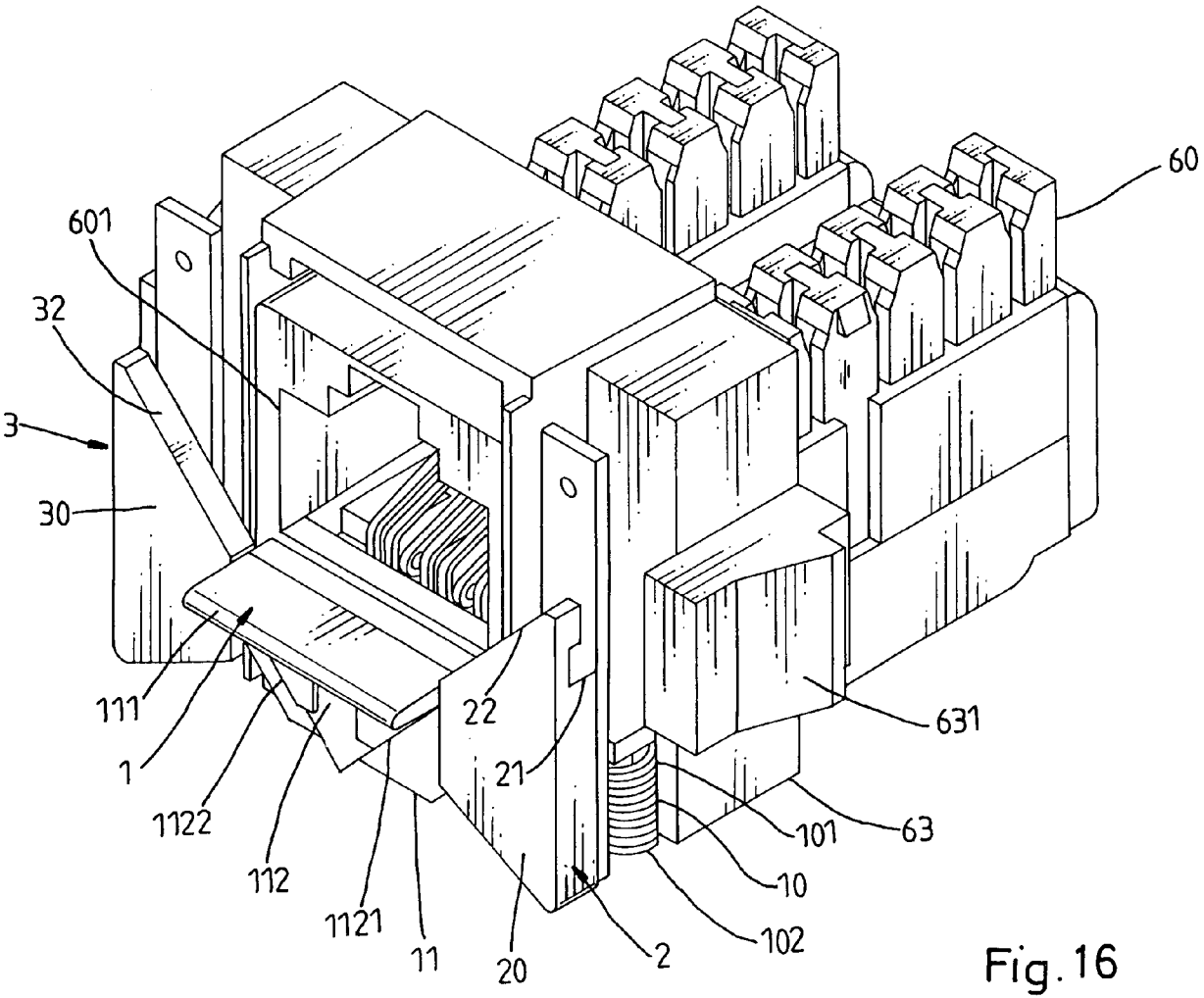
FIG. 16 is an elevational view of the first embodiment of the present invention, showing the open status of the electric outlet dust protective structure (II).
Figure 17:
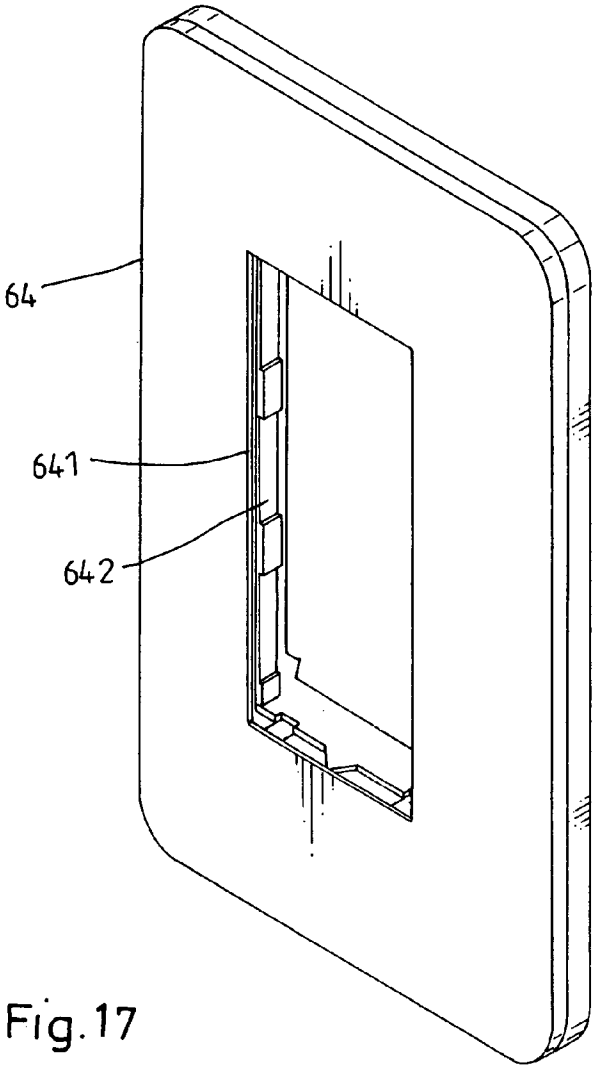
FIG. 17 is an elevational view of the face panel for the electric outlet dust protective structure according to the first embodiment of the present invention.
Figure 18:
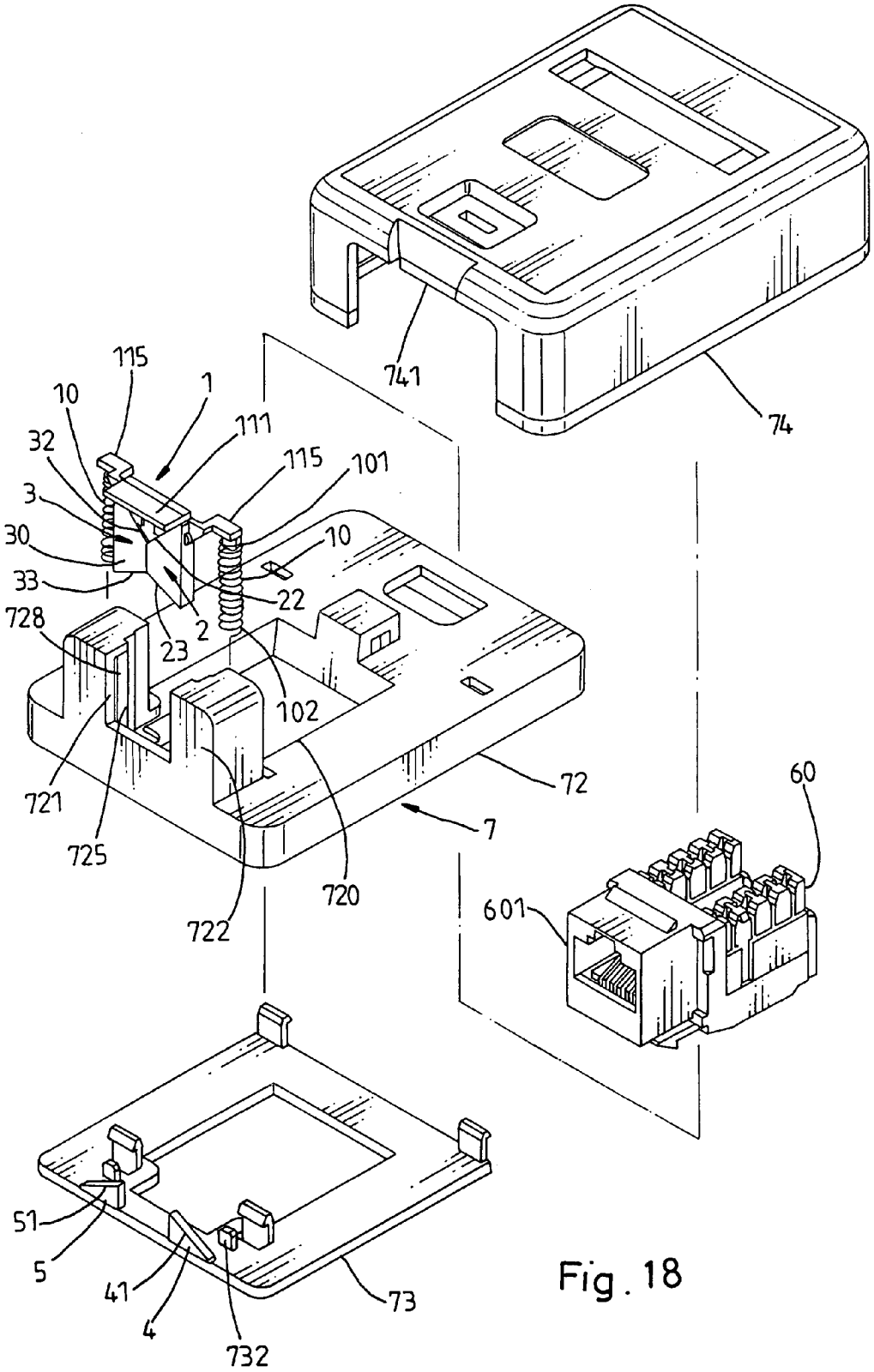
FIG. 18 is an exploded view of an electric outlet dust protective structure according to the second embodiment of the present invention.
Figure 19:
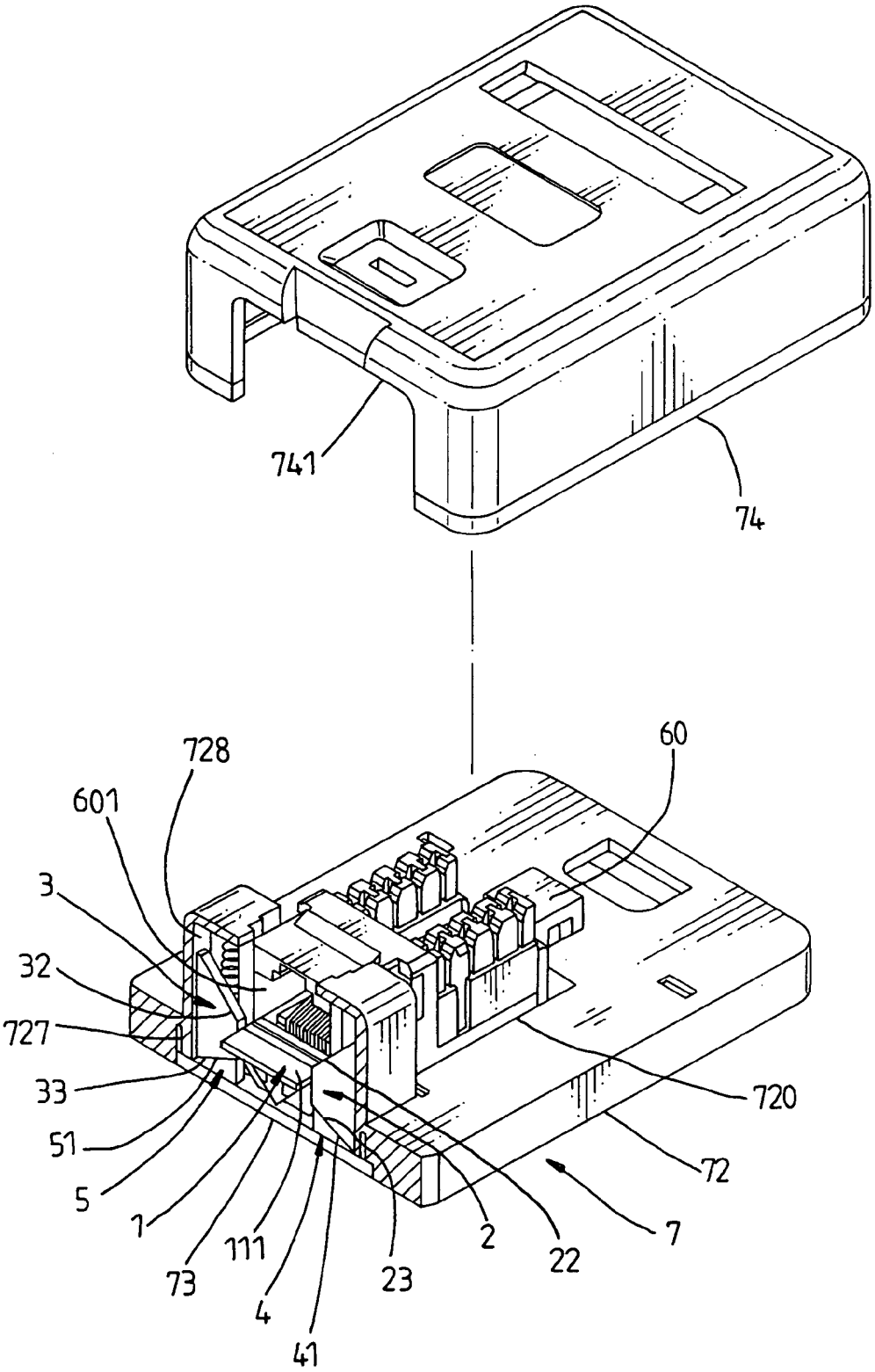
FIG. 19 is another exploded view of the second embodiment of the present invention (the cover shell not shown).
Figure 20:
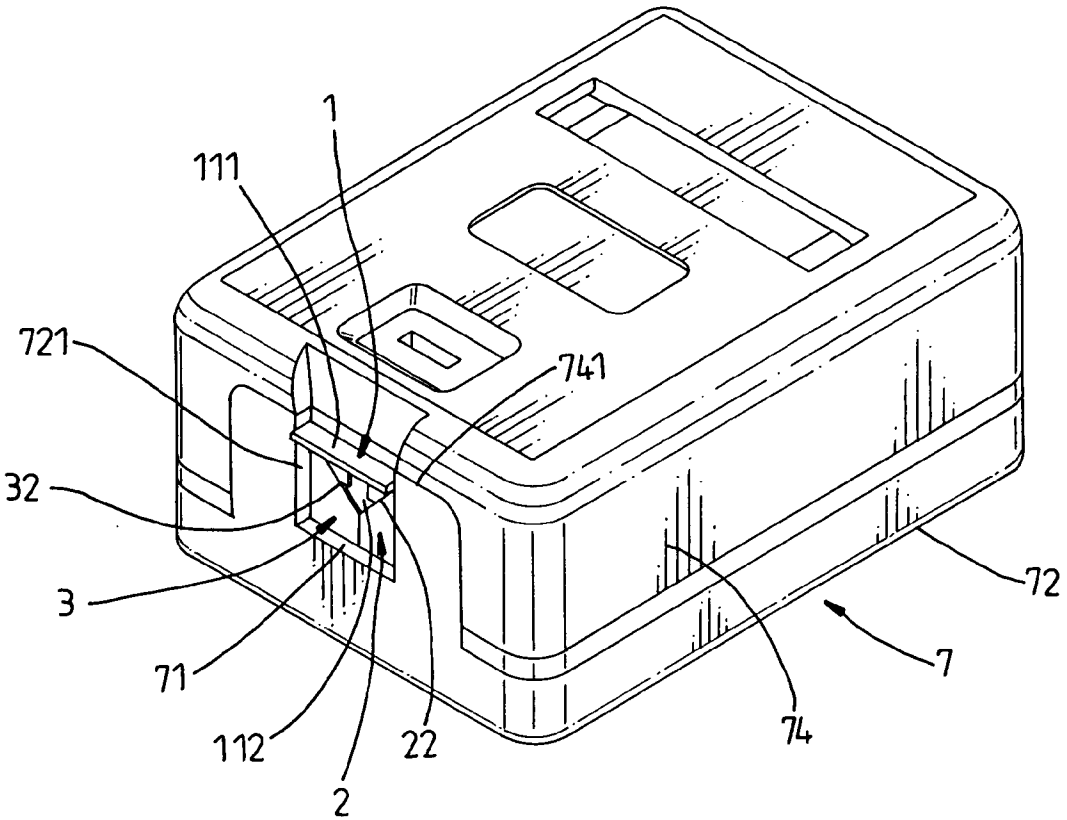
FIG. 20 is an elevational assembly view of the electric outlet dust protective structure according to the second embodiment of the present invention.
Figure 21:
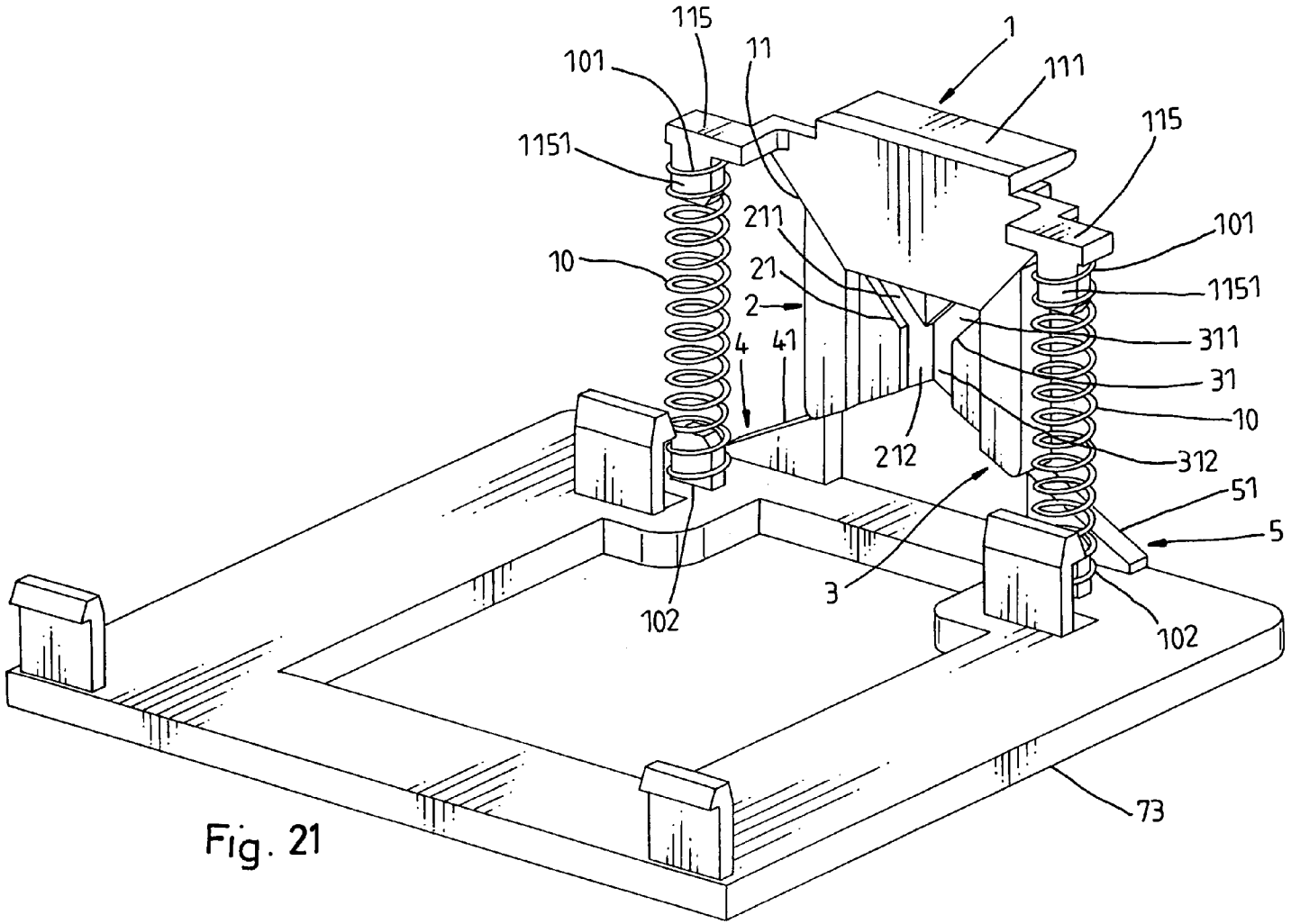
FIG. 21 is a rear elevational view in an enlarged scale of a part of the electric outlet dust protective structure according to the second embodiment of the present invention.
Figure 22:
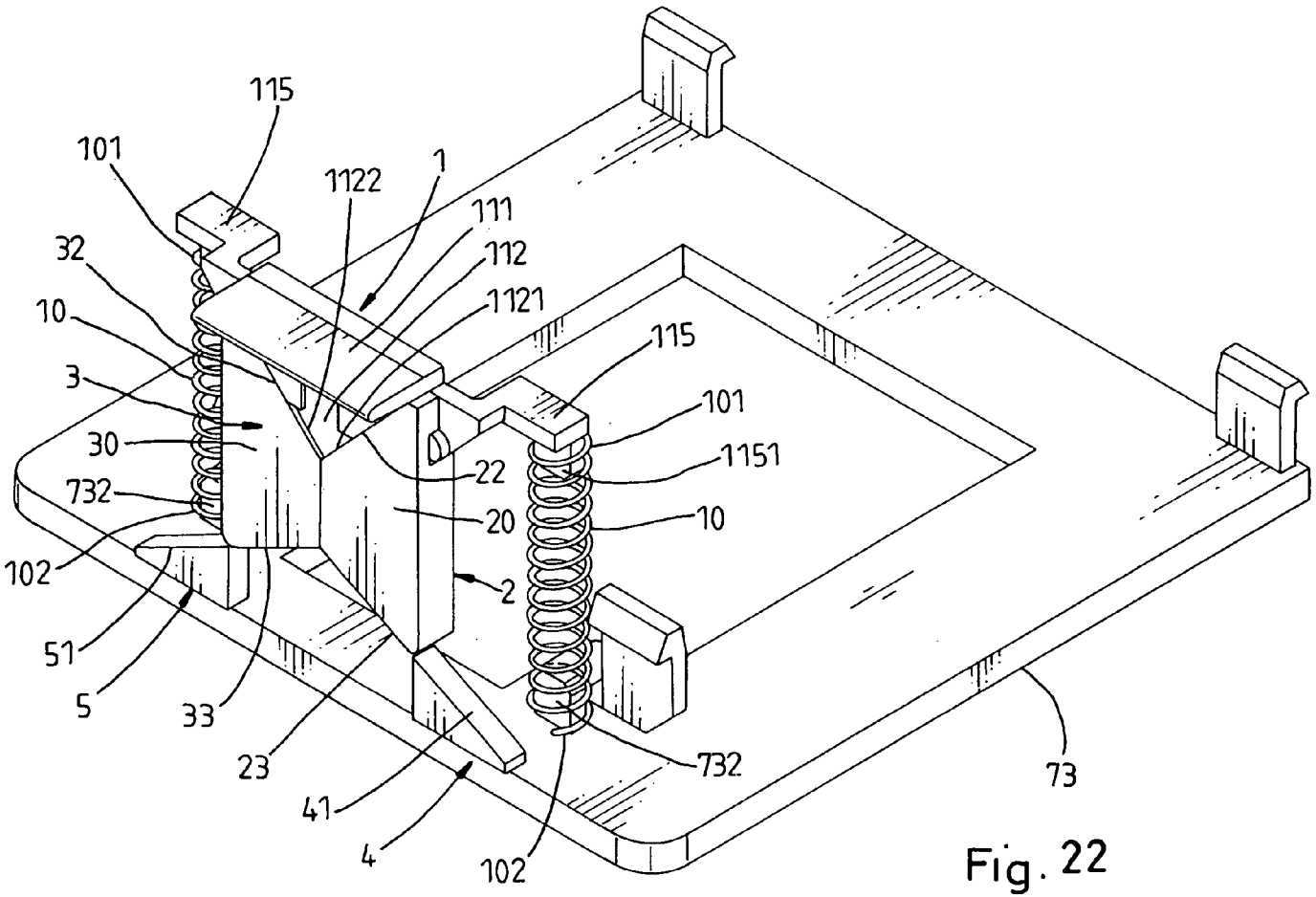
FIG. 22 is an oblique front elevation of the assembly of FIG. 21.
Figure 23:
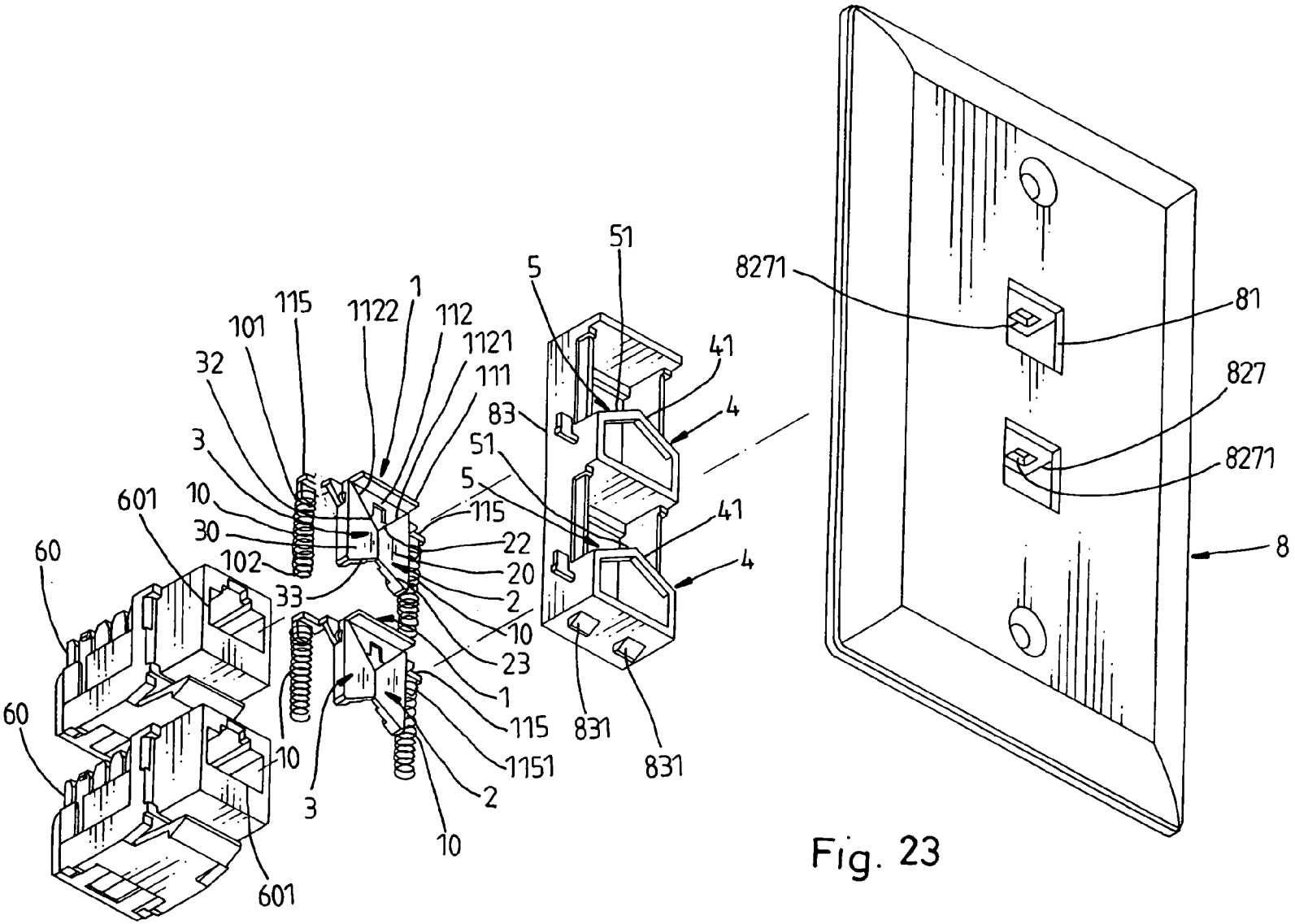
FIG. 23 is an exploded front view of an electric outlet dust protective structure according to the third embodiment of the present invention.
Figure 24:
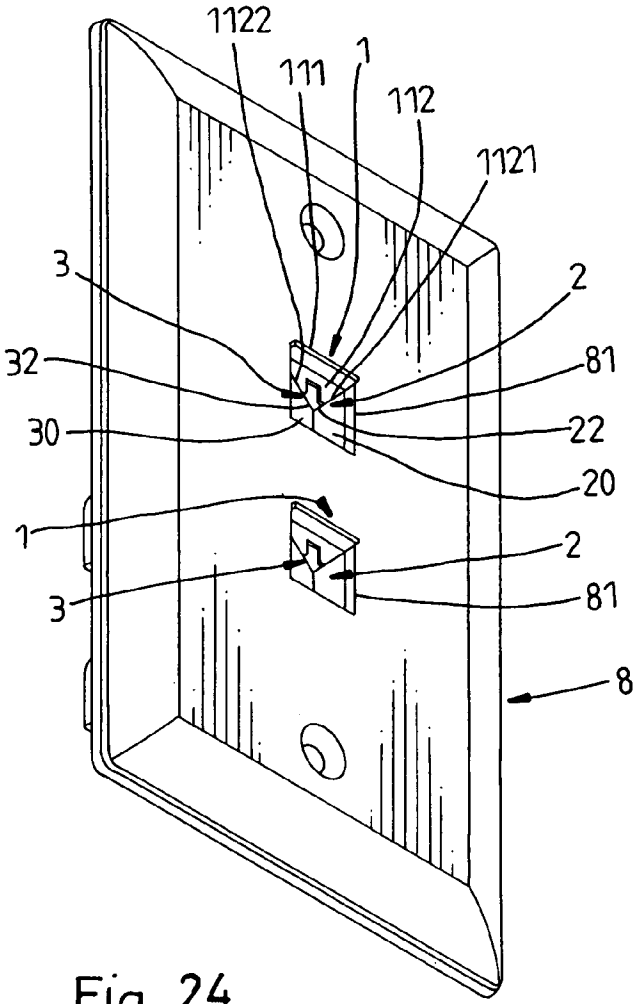
FIG. 24 is an elevational assembly view of the electric outlet dust protective structure according to the third embodiment of the present invention.
Figure 25:
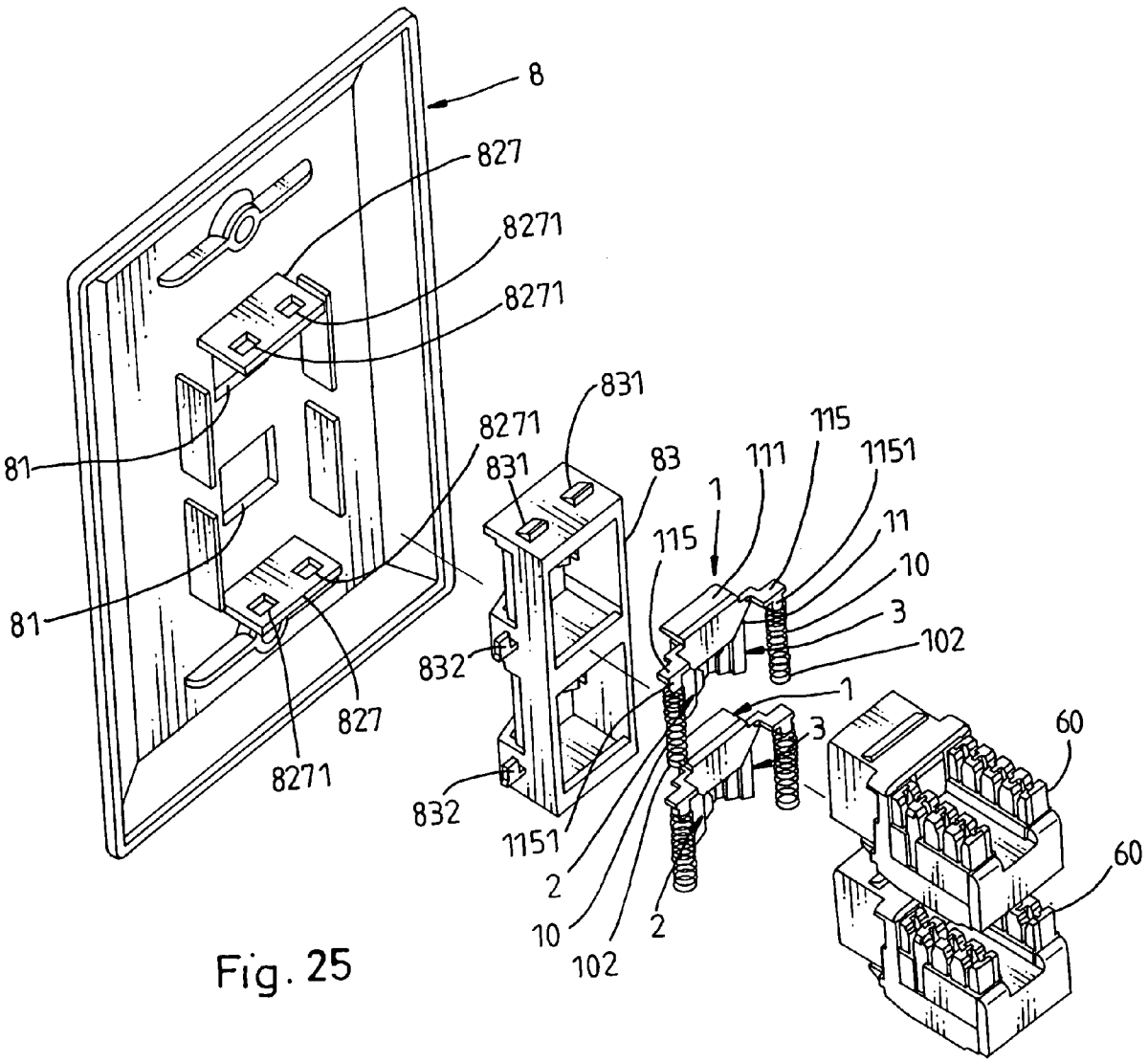
FIG. 25 is an exploded rear side view of the electric outlet dust protective structure according to the third embodiment of the present invention.
Figure 26:
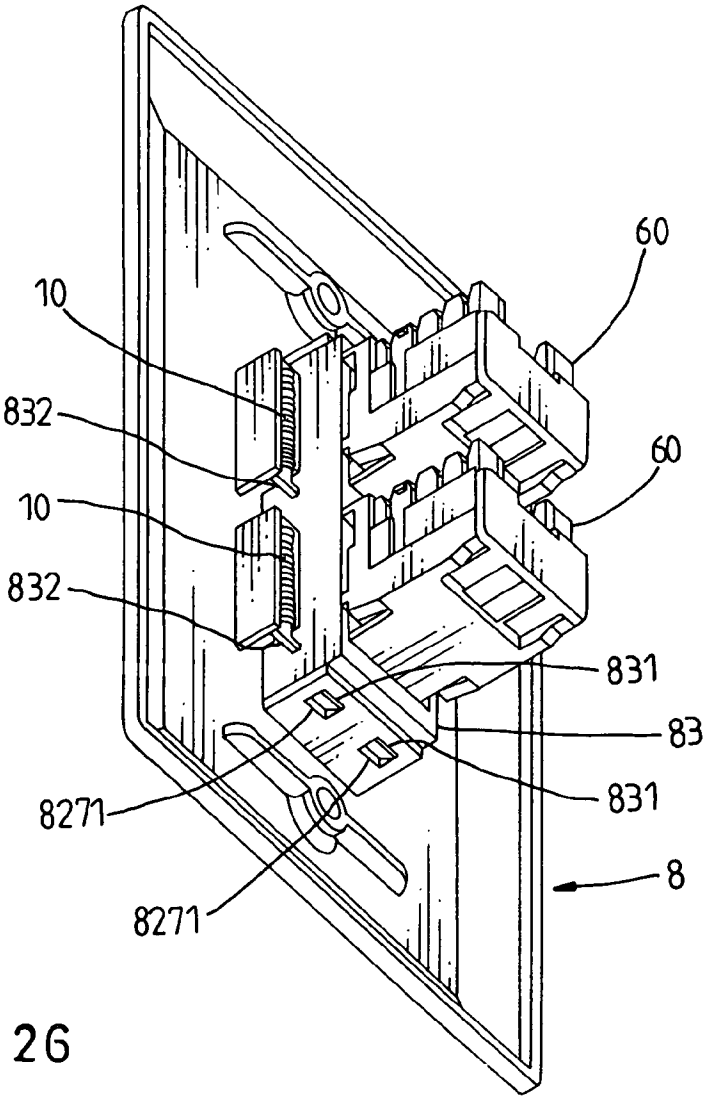
FIG. 26 is an assembly view of FIG. 25.
Figure 27:
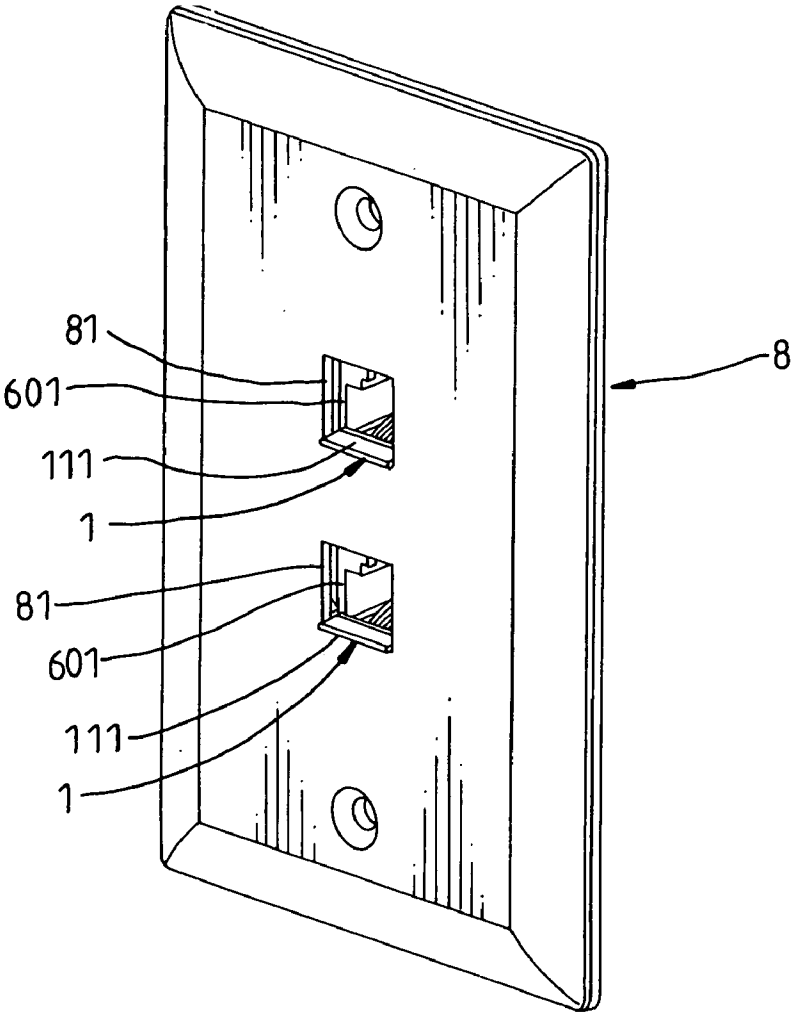
FIG. 27 is a front view of FIG. 26.

The compression springs 10 impart an upward pressure to the side wings 115 of the top dust cover 1, thereby forcing the finger strip 111 against the top side of the periphery of the front opening 61 of the housing 6, and therefore the actuating block 112 and the front faces 20, 30 of the left and right side dust covers 2, 3 block the front opening 61 of the housing 6 against outside dust (see FIGS. 13 and 14). When wishing to connect a muddle plug to the module jack (terminal holder body) 60 in the housing 6, press the finger strip 111 of the top dust cover 1 to force the sloping side edges 1121, 1122 of the actuating block 112 of the top dust cover 1 against the sloping top guide faces 22, 32 of the left and right side dust covers 2, 3. Therefore, the left and right side dust covers 2, 3 are respectively moved along the sloping guide faces 41, 51 of the left and right guide rails 4, 5 at the bottom wall of the casing 62 of the housing 6, and at the same time, the guide rods 113, 114 of the top dust cover 1 are moved downwards along the back sliding grooves 21, 31 of the left and right side dust covers 2, 3. When the finger strip 111 of the top dust cover 1 touched the bottom side of the periphery of the front opening 61 of the housing 6 (see FIG. 16), the guide rods 113, 114 of the top dust cover 1 are moved to the bottom ends of the vertical groove sections 212, 312 of the back sliding grooves 21, 31 and stopped against the left and right guide rails 4, 5 (see FIG. 11). On the contrary, when released the hand from the finger strip 111 of the top dust cover 1, the compression springs 10 immediately push the top dust cover 1 upwards, and the guide rods 113, 114 of the top dust cover 1 are moved upwards from the vertical groove sections 212, 312 of the back sliding grooves 21, 31 of the left and right side dust covers 2, 3 into the respective sloping groove sections 211, 311, and therefore the left and right side dust covers 2, 3 are respectively obliquely moved upwards and returned to the respective former positions to close the front opening 61 of the housing 6 with the top dust cover 1 (see FIGS. 10 and 13).

The back cover 63 is fastened to the casing 62 of to hold the module jack (terminal holder body) 60 inside the housing 6, keeping the insertion hole 601 of the module jack (terminal holder body) 60 aimed at the front opening 61 of the housing 6. The back cover 63 has two hooks 631 respectively fastened to respective retaining holes 67 at two sides of the casing 62. After installation of the back cover 63 and the module jack (terminal holder body) 60 in the casing 62, the top dust cover 1 and the left and right side dust covers 2, 3 are movably supported between the front side of the module jack (terminal holder body) 60 and the front wall 620 of the casing 62 of the housing 6. The casing 62 further comprises a plurality of retaining flanges 622 symmetrically disposed at two sides of the front opening 61. The faceplate 64 is fastened to the front side of the casing 62, having an opening 641 corresponding to the front opening 61 of the casing 62 and a plurality of recessed retaining portions 642 symmetrically disposed at two sides of the opening 641 and respectively forced into engagement with the retaining flanges 622 (see FIG. 17).

Figure 10:
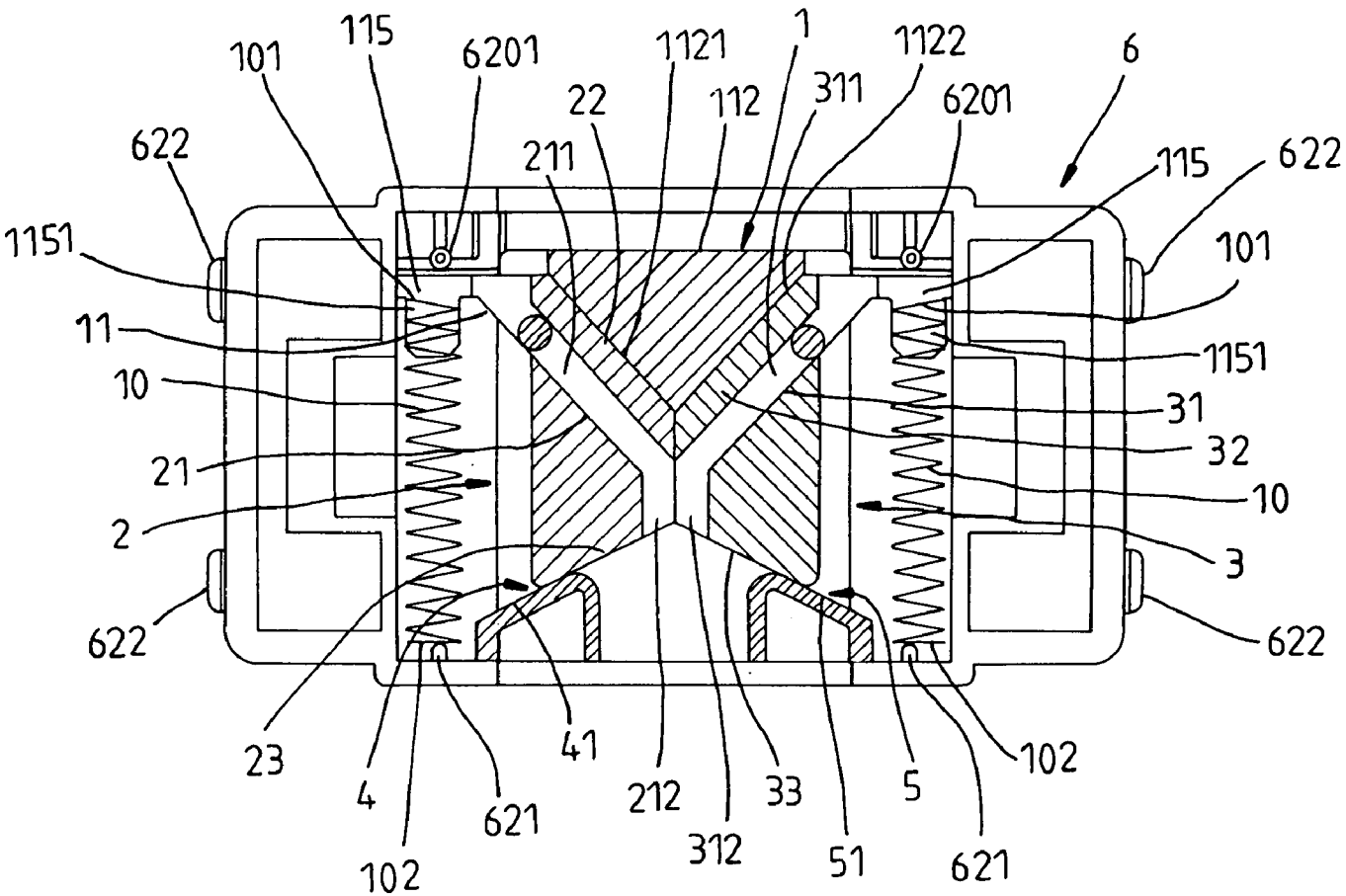
FIG. 10 is a sectional assembly view of the electric outlet dust protective structure according to the first embodiment of the present invention.
Figure 11:
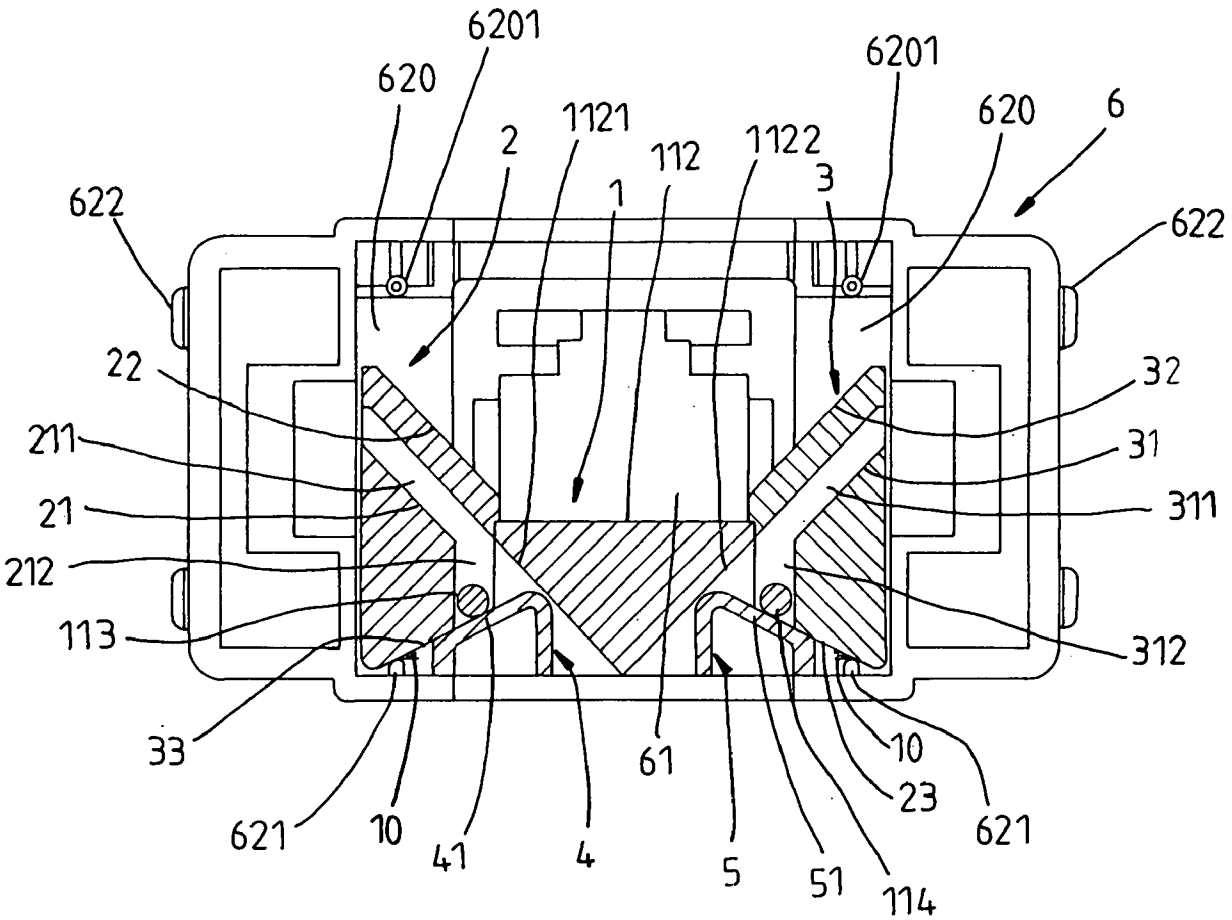
FIG. 11 is a schematic sectional view of the first embodiment of the present invention, showing the open status of the electric outlet dust protective structure.
Figure 12:
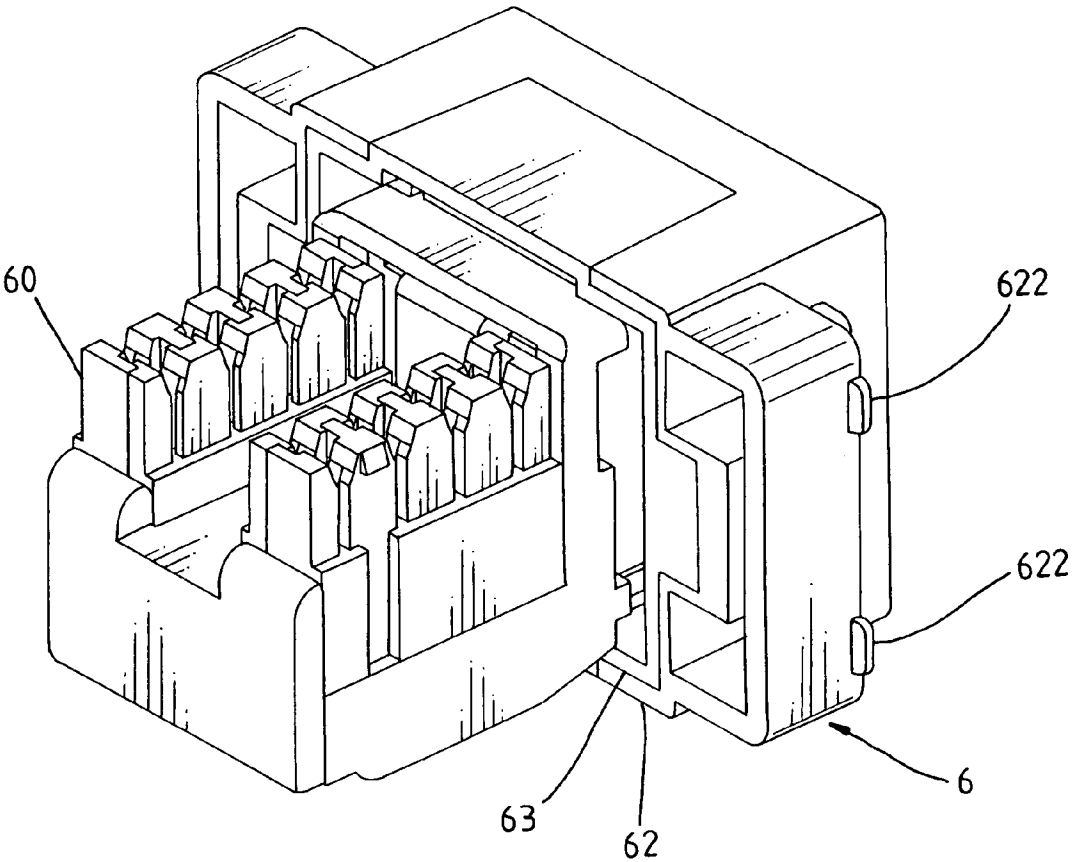
FIG. 12 is an oblique rear elevation of the assembly of the electric outlet dust protective structure according to the first embodiment of the present invention.

The two locating plates 66 are vertically mounded inside the housing 6 to support the compression springs 10, each having a bottom end 661 respectively engaged into a respective locating hole 662 in the bottom wall of the casing 62 of the housing 6 behind the locating blocks 621 and a locating hole 662 disposed near the top and respectively coupled to a respective locating rod 6201 at the front wall 620 of the casing 62 of the housing 6 (see FIG. 10).

FIGS. 18~22 show an electric outlet dust protective structure according to the second embodiment of the present invention. The electric outlet dust protective structure is comprised of a top dust cover 1, left and right side dust covers 2, 3, left and right guide rails 4, 5, two compression springs 10, and an electric outlet formed of a housing 7 and a module jack (terminal holder body) 60. According to this embodiment, the top dust cover 1, the left and right side dust covers 2, 3, the left and right guide rails 4, 5, and the springs 10 are same as the like members shown in the aforesaid first embodiment of the present invention. However, the housing 7 is shaped like a box comprised of a base block 72, a bottom frame 73 fastened to the bottom side of the base block 72, and a cover shell 74. The left and right guide rails 4, 5 are provided at the front side of the bottom frame 73 and have the respective sloping guide faces 41, 51 disposed in contact with the sloping bottom guide edges 23, 33 of the left and right side dust covers 2, 3. The base block 72 comprises a recessed accommodating chamber 720, which accommodates the module jack (terminal holder body) 60, an upright front wall 722, and an opening 721 in the upright front wall 722. The cover shell 74 has an opening 741 in the front side. When assembled, the opening 721 of the upright front wall 722 and the opening 741 of the cover shell 74 form a front opening 71 in line with thee insertion hole 601 of the module jack (terminal holder body) 60, and the top dust cover 1 with the left and right side dust covers 2, 3 are movably disposed between the module jack (terminal holder body) 60 and the upright front wall 722 of the base block 72.

Further, the bottom frame 73 comprises two upright rods 732 that hold the compression springs 10 in place, an upright partition plate 725 spaced behind the upright front wall 722 and defining with the upright front wall 722 a space 728 for receiving the top dust cover 1 and the left and right side dust covers 2, 3, and a bottom opening 727 in communication with the space 728 for accommodating the left and right guide rails 4, 5.

FIGS. 23~27 show a third embodiment of the present invention. This embodiment is a combination of two electric outlet dust protective structures made according too the aforesaid first embodiment of the present invention. According to this embodiment, a rack 83 is provided at the back side of the faceplate 8 to hold two dust shutter units each formed of a top dust cover 1, a left side dust cover 2, a right side dust cover 3, and two compression springs 10. The faceplate 8 comprises two locating flanges 827 perpendicularly extended from the back wall at different elevations, and two insertion holes 81 disposed at different elevations between the locating flanges 827. The locating flanges 827 each have a plurality of retaining holes 8271. The rack 83 comprises a plurality of hooks 831 respectively fastened to the retaining holes 8271, and a plurality of locating rods 832 that support the compression springs 10.

A prototype of electric outlet dust protective structure has been constructed with the features of FIGS. 7~27. The electric outlet dust protective structure functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electric outlet dust protective structure comprising:

a housing having a front opening and holding a module jack having an insertion hole, said housing being formed of a casing, a faceplate, and a back cover;

a top dust cover, said top dust cover comprising a flat base, a finger strip extended from a top side of said flat base at right angles and inserted through the front opening of said housing from an inside toward an outside, an actuating block protruded from a front side of said flat base, said actuating block having two sloping side edges sloping downwardly inwards and then meeting each other at a point, two guide rods perpendicularly extended from said flat base and respectively spaced from said sloping side edges of said actuating block at a distance, two side wings symmetrically disposed at two opposite lateral sides of the flat base, and two locating rods respectively downwardly extended from said side wings;

left and right guide rails provided at said casing of said housing, said left and right guide rails each having a sloping guide face sloping downwardly inwards;

two compression springs respectively supported between said top dust cover and said casing, said compression springs each having a top end respectively fastened to the locating rods of said top dust cover and a bottom end respectively fastened to a respective locating block at said casing; and left and right side dust covers, said left and right side dust covers each having a sloping top guide face fitting the sloping side edges of said actuating block of said top dust cover, a sloping bottom guide edge respectively kept in contact with the sloping guide faces of said left and right guide rails, and a back sliding groove respectively coupled to the guide rods of said top dust cover;

wherein said compression springs impart an upward pressure to the side wings of said top dust cover, thereby forcing said finger strip against a top side of the periphery of the front opening of said housing, and therefore said actuating block and said left and right side dust covers block the front opening of said housing against outside dust; pressing said finger strip of said top dust cover to force the sloping side edges of said actuating block of said top dust cover against the sloping top guide faces of said left and right side dust covers causes said left and right side dust covers to move along the sloping guide faces of said left and right guide rails, and at the same time, said guide rods of said top dust cover are moved downwards along said back sliding grooves of said left and right side dust covers and stopped against said left and right guide rails; on the contrary, when released the hand from said finger strip of said top dust cover, said compression springs immediately push said top dust cover upwards, and said guide rods of said top dust cover are moved upwards along said back sliding grooves, and therefore said left and right side dust covers are respectively obliquely moved upwards and returned to close the front opening of said housing with said top dust cover.

2. The electric outlet dust protective structure as claimed in claim 1, wherein said back cover is fastened to said casing of to hold said module jack inside said housing, keeping the insertion hole of said module jack aimed at the front opening of said housing, said back cover having two hooks respectively fastened to respective retaining holes at two sides of said casing; said top dust cover and said left and right side dust covers are movably supported between said module jack and said casing; said casing comprises a plurality of retaining flanges symmetrically disposed at two sides of said front opening; said faceplate is fastened to said casing, having an opening corresponding to said front opening and a plurality of recessed retaining portions respectively forced into engagement with said retaining flanges of said casing.

3. The electric outlet dust protective structure as claimed in claim 1, further comprising two locating plates vertically mounded inside said housing to support said compression springs, said locating plates each having a bottom end respectively engaged into a respective locating hole in said casing and a locating hole disposed near a top end thereof and respectively coupled to a respective locating rod at said casing.

4. An electric outlet dust protective structure comprising:

a housing having a front opening and holding a module jack having an insertion hole, said housing comprising a base block, a bottom frame fastened to said base block at a bottom side, and a cover shell covering said base block, said base block comprising a recessed accommodating chamber, which accommodates said module jack a top dust cover, said top dust cover comprising a flat base, a finger strip extended from a top side of said flat base at right angles and inserted through the front opening of said housing from an inside toward an outside, an actuating block protruded from a front side of said flat base, said actuating block having two sloping side edges sloping downwardly inwards and then meeting each other at a point, two guide rods perpendicularly extended from said flat base and respectively spaced from said sloping side edges of said actuating block at a distance, two side wings symmetrically disposed at two opposite lateral sides of the flat base, and two locating rods respectively downwardly extended from said side wings;

left and right guide rails provided at said bottom plate in front of said base block, said left and right guide rails each having a sloping guide face sloping downwardly inwards;

two compression springs respectively supported between said top dust cover and said casing, said compression springs each having a top end respectively fastened to the locating rods of said top dust cover and a bottom end respectively fastened to a respective locating block at said casing; and left and right side dust covers, said left and right side dust covers each having a sloping top guide face fitting the sloping side edges of said actuating block of said top dust cover, a sloping bottom guide edge respectively kept in contact with the sloping guide faces of said left and right guide rails, and a back sliding groove respectively coupled to the guide rods of said top dust cover;

wherein said compression springs impart an upward pressure to the side wings of said top dust cover, thereby forcing said finger strip against a top side of the periphery of the front opening of said housing, and therefore said actuating block and said left and right side dust covers block the front opening of said housing against outside dust; pressing said finger strip of said top dust cover to force the sloping side edges of said actuating block of said top dust cover against the sloping top guide faces of said left and right side dust covers causes said left and right side dust covers to move along the sloping guide faces of said left and right guide rails, and at the same time, said guide rods of said top dust cover are moved downwards along said back sliding grooves of said left and right side dust covers and stopped against said left and right guide rails; on the contrary, when released the hand from said finger strip of said top dust cover, said compression springs immediately push said top dust cover upwards, and said guide rods of said top dust cover are moved upwards along said back sliding grooves, and therefore said left and right side dust covers are respectively obliquely moved upwards and returned to close the front opening of said housing with said top dust cover.

5. The electric outlet dust protective structure as claimed in claim 4, wherein said base block comprises an upright front wall and an opening in said upright front wall; two upright rods that hold said compression springs in place, an upright partition plate spaced behind said upright front wall and defining with said upright front wall a space for receiving said top dust cover and said left and right side dust covers, and a bottom opening in communication with the space between said upright partition plate and said upright front wall for accommodating said left and right guide rails; said cover shell has an opening forming with the opening in said upright front wall the front opening of said housing.

6. An electric outlet dust protective structure comprising:

a housing having a front opening and holding a module jack having an insertion hole, said housing comprising a faceplate, and a rack fastened to a back side of said faceplate;

a top dust cover mounted inside said rack, said top dust cover comprising a flat base, a finger strip extended from a top side of said flat base at right angles and inserted through the front opening of said housing from an inside toward an outside, an actuating block protruded from a front side of said flat base, said actuating block having two sloping side edges sloping downwardly inwards and then meeting each other at a point, two guide rods perpendicularly extended from said flat base and respectively spaced from said sloping side edges of said actuating block at a distance, two side wings symmetrically disposed at two opposite lateral sides of the flat base, and two locating rods respectively downwardly extended from said side wings;

left and right guide rails provided inside said rack, said left and right guide rails each having a sloping guide face sloping downwardly inwards;

two compression springs respectively supported between said top dust cover and a part inside said rack, said compression springs each having a top end respectively fastened to the locating rods of said top dust cover and a bottom end respectively fastened to said rack and left and right side dust covers, said left and right side dust covers each having a sloping top guide face fitting the sloping side edges of said actuating block of said top dust cover, a sloping bottom guide edge respectively kept in contact with the sloping guide faces of said left and right guide rails, and a back sliding groove respectively coupled to the guide rods of said top dust cover;

wherein said compression springs impart an upward pressure to the side wings of said top dust cover, thereby forcing said finger strip against a top side of the periphery of the front opening of said housing, and therefore said actuating block and said left and right side dust covers block the front opening of said housing against outside dust; pressing said finger strip of said top dust cover to force the sloping side edges of said actuating block of said top dust cover against the sloping top guide faces of said left and right side dust covers causes said left and right side dust covers to move along the sloping guide faces of said left and right guide rails, and at the same time, said guide rods of said top dust cover are moved downwards along said back sliding grooves of said left and right side dust covers and stopped against said left and right guide rails; on the contrary, when released the hand from said finger strip of said top dust cover, said compression springs immediately push said top dust cover upwards, and said guide rods of said top dust cover are moved upwards along said back sliding grooves, and therefore said left and right side dust covers are respectively obliquely moved upwards and returned to close the front opening of said housing with said top dust cover.

7. The electric outlet dust protective structure as claimed in claim 6, wherein said faceplate comprises two locating flanges perpendicularly extended from the back side at different elevations, said locating flanges each having a plurality of retaining holes; said rack comprises a plurality of hooks respectively fastened to said retaining holes of said locating flanges of said faceplate, and a plurality of locating rods that support the compression springs.

* * * * *